US005228593A

United States Patent [19]

O'Meara

[11] Patent Number: 5,228,593

[45] Date of Patent: Jul. 20, 1993

[54] CONTAINER-CLOSURE ASSEMBLY

[75] Inventor: John R. O'Meara, Rossmoor, N.J.

[73] Assignee: CP Packaging, Inc., Jamesburg, N.J.

[21] Appl. No.: 785,438

[22] Filed: Oct. 24, 1991

[51] Int. Cl.[5] ..... B67D 5/22

[52] U.S. Cl. ..... 222/41; 215/32; 215/253; 220/266; 222/107; 222/153; 222/541

[58] Field of Search ..... 222/39, 41, 83.5, 92, 222/107, 153, 541; 215/32, 253; 220/266

[56] References Cited

U.S. PATENT DOCUMENTS

| | | | |
|---|---|---|---|
| 1,959,260 | 5/1934 | Angyal | 222/541 |
| 4,134,511 | 1/1979 | Deussen | 215/32 |
| 4,492,317 | 1/1985 | Guess et al. | 222/39 |
| 4,688,703 | 8/1987 | Bayer | 222/541 |
| 4,773,548 | 9/1988 | Deussen | 222/541 X |

*Primary Examiner*—Andres Kashnikow

*Assistant Examiner*—Joseph A. Kaufman

*Attorney, Agent, or Firm*—Eugene E. Renz, Jr.

[57] ABSTRACT

A cap and tube assembly comprising a tube having a neck ending in a discharge end having an outwardly extending stem frangibly supported at a point recessed from the outer terminal end of the neck to define an outlet when the stem is removed. A cap sized to slightably fit the neck and including an inwardly facing stem engaging the socket is provided, positively locking the stem in the socket in a predetermined position. The cap is located at a first position where the stem and socket are spaced apart and at a second position defined by the predetermined position of a stem locking device. The stem is frangibly supported on the discharge end by an annular thin wall and a plurality of axially extending bridges for resisting axial movement of the stem and permitting rotational movement to rupture the thin wall to form an outlet for the tube.

8 Claims, 2 Drawing Sheets

FIG. 3
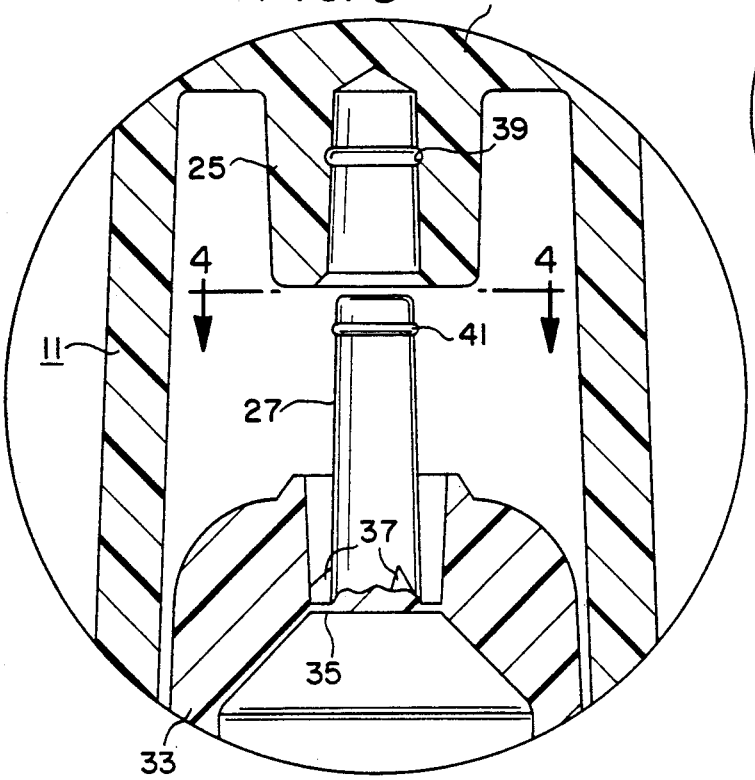
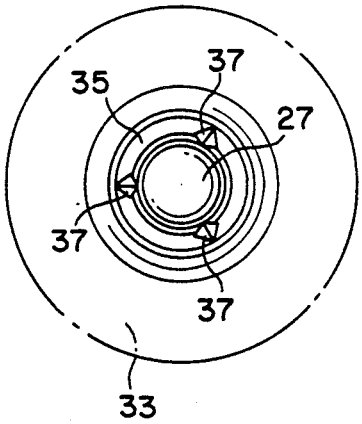
FIG. 4
FIG. 6
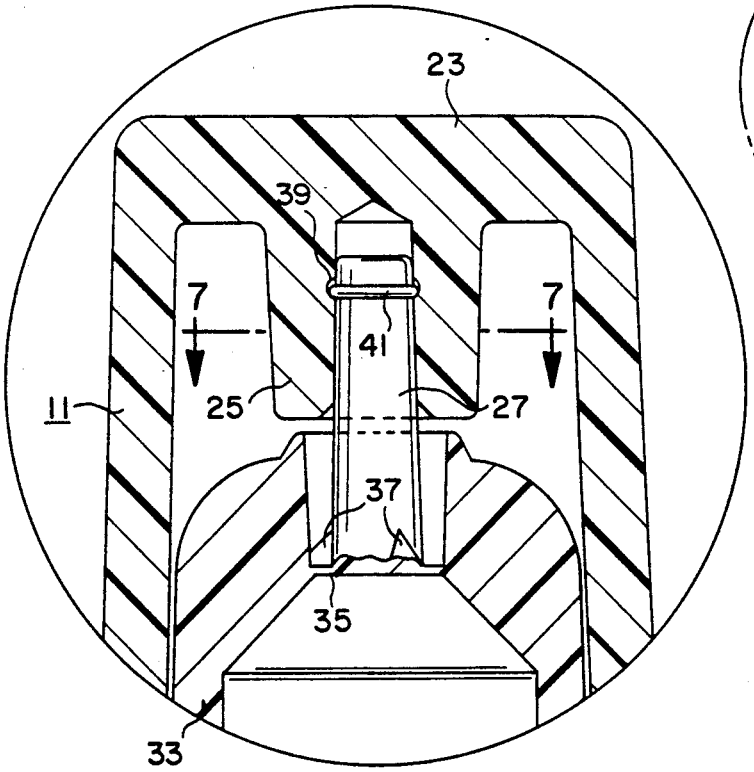
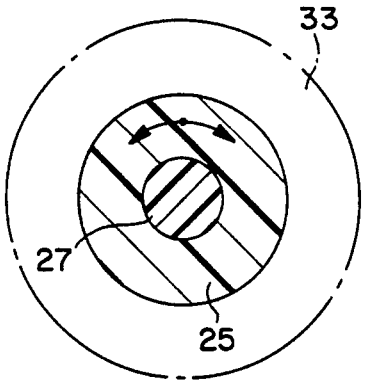
FIG. 7

CONTAINER-CLOSURE ASSEMBLY

FIELD OF THE INVENTION

The present invention relates to a sterile cap and tube assembly which is activated by further engagement of the cap on the tube. More particularly, the invention relates to cap and tube assemblies in which a stem closing a discharge end is removed by engagement of the stem with a socket in the cap, followed by fracture of a frangible support of the stem on the tube nozzle and removal of the cap with the stem.

BACKGROUND OF THE INVENTION

There are a variety of applications in which a single dose of a medicine, reagent, or other material is packaged in a disposable container under sealed conditions. Often times, these packages include a method for opening the assembly to provide access to the contents of the container without resort to additional tools or equipment.

One form of these containers may be generally described as a container having the nozzle for discharge of the contents, wherein the nozzle supports a stem like element on a frangible diaphragm molded or otherwise formed in the discharge opening. The cap is somehow caused to interact with the stem, usually with the use of a socket, whereby a fit between the stem and socket ruptures the frangible diaphragm and causes removal of the stem.

One example of this device is shown in the U.S. Pat. No. 4,773,584. In this patent, a cap and tube are combined such that a frangible web supports a projection which has knurling thereon. The cap is initially mounted on the nozzle of the tube to protect the projection. The cap has an end for acting as a cover with a reverse end having a central socket, and having axially extending ribs. The ribs and the knurling frictionally engage and interlock with each other. The obvious drawback of this design is that the activation end of the cap is exposed to the outside and can become contaminated. In addition, the cap must be taken off and turned over in order to activate the system. This requires both hands at some time during the removal of the stem or projection.

A design which avoids the sanitation problems of the above identified patent, is shown in U.S. Pat. No. 4,134,511. This patent describes a container with a neck having an elongated solid projection on the tip. The projection is integrally connected to the tip by a reduced wall portion forming a frangible annular link whose rupture creates an outlet. The neck is closely surrounded by a cap which firmly engages this removable tip and cannot be detached until the tip has been broken off. In other words, the tip is firmly mounted in the cap.

As shown in U.S. Pat. No. 4,134,511, the tip has a smooth surface close to the neck but is polygonal over the greater part of its length. A hexagonal shape is preferred. This tip is then press fit into a socket of the same polygonal shape and both the tip and the socket have a slight taper to limit the extent to which the neck can be inserted into the cap.

The problems with this design are several. First, there is no way to prevent the, tip from being pushed into the container when an axial force is inadvertently applied to the cap. Since the tip and cap are always in contact, there is a serious risk of inadvertent activation. Any time there is a one step activation, it is possible for children and others not authorized to have access to the contents to inadvertently or intentionally open the product. Another drawback of this design is that axial activation is possible even though the design is intended to have a rotational movement to cause the fracture or rupture of the frangible area holding the tip on the nozzle. Finally, the tip is mounted to the nozzle at the top of the nozzle. When the container is used for eye drops, removal of the cap may provide a torn edge of the frangible portion which may scrape or scratch the eye. Similarly, when baby vitamins are dispensed from the container, a quick movement by the child could cause a cut or worse.

Accordingly, it is an object of the present invention to provide a safe and efficient method for storing and dispensing materials in a container.

Another object of the present invention is to provide a container of the type described which employs a stem and socket in a manner which avoids the problems of the prior art and which provides additional benefits and safety features.

Specifically, it is an object of this invention to provide a cap and tube assembly which normally exists in a non-activated condition and which requires a multiple step activation process prior to discharge of the contents. Other objects appear hereinafter.

SUMMARY OF THE INVENTION

It has now been discovered that the above and other objects of the present invention may be accomplished in the following manner. Specifically, the invention comprises an improved cap and tube assembly.

The tube includes a neck ending in a discharge end having an outwardly extending stem. This stem is mounted on the end of the tube neck with a frangible support at a point recessed from the outer terminal end of the neck in order to define an outlet when the stem is removed.

The assembly also includes a cap which is sized to slidably fit the neck. The cap includes an inwardly facing stem engaging socket for engaging the stem. The stem and socket include a stem locking means for positively locking the stem in the socket upon its insertion into the socket to a predetermined position. Additionally, the assembly includes a location means cooperatively positioned on the neck and cap to locate the cap at a first unarmed position where the stem and socket are spaced apart from one another and a second armed position which is defined by the predetermined position of the stem locking means.

In a preferred embodiment, the stem is frangibly supported on the discharge end by an annular thin wall portion and by a plurality of axially extending bridges which resist axial movement of the stem and permit engagement of the locking means at said predetermined position. In one embodiment, the engagement in the predetermined position of the stem and the socket is designed to provide a signal capable of being sensed by a user. This signal may be audible, such as by a click from a ring and groove engaging one another. Alternatively, it may just be tactile, as the user feels a ring and groove engaging as they locate the stem in the socket at the predetermined position.

In another embodiment, the stem and socket are sized to have a friction fit at the predetermined position in order to facilitate cooperative circumferential axial rotation of the stem and rupture of the frangible support.

Finally, in yet another embodiment of the present invention, the assembly includes a first indicia indicating a first condition prior to insertion of the stem and socket to said predetermined position. Normally, this will be the unarmed position wherein the stem and socket are spaced from one another. One variation of this embodiment is to provide a clear cap so that the relationship between the stem and the socket is clearly visible. A further part of this embodiment includes a second indicia indicating a second condition after insertion of the stem and socket to said second or predetermined position, followed by axial rotation to rupture said frangible support. This indicia may be in the form of markings around the cap.

BRIEF DESCRIPTION OF THE DRAWINGS

These and other objects of the present invention and the various features and details of the operation and construction thereof are hereinafter more fully set forth with reference to the accompanying drawings, where:

FIG. 3 is a greatly enlarged fragmentary, sectional, elevational view of the details contained within the dot and dash circle of FIG. 2 and designated FIG. 3;

FIG. 4 is a fragmentary plan view taken along the line 4, 4 of FIG. 3, showing additional details of the discharge end of the nozzle tip;

FIG. 6 is a greatly enlarged fragmentary, sectional, elevational view of the details contained with the dot and dash circle shown in FIG. 5 and designed FIG. 6 showing details of the closure member in an armed position;

FIG. 7 is a fragmentary sectional plan view taken along the line 7, 7 of FIG. 6;

DETAILED DESCRIPTION OF THE PREFERRED EMBODIMENT

Figure 1:
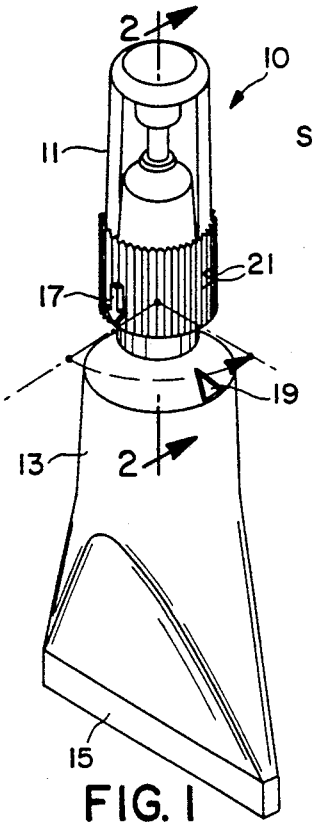
FIG. 1 is a perspective view of a tamper evident and child resistant collapsible tube container with a multiple step activation enclosure in accordance with the present invention.
Figure 2:
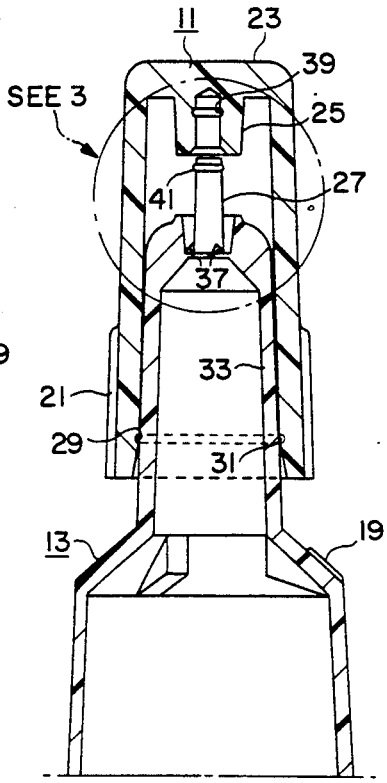
FIG. 2 is an enlarged fragmentary, sectional, elevational view taken along the line 2, 2 of FIG. 1.

Shown in FIG. 1 is a perspective view of the preferred embodiment of the present invention, shown generally as 10. The device includes a cap 11 and a tube 13. Tube 13 is collapsible and may contain medicaments, ointments, eye drops and other products, either in a single dose quantity or in more than one dose. The present invention is admirably suited to both single dose treatments and multiple dose portions. The contents are placed in the tube and end 15 is closed, such as by crimping.

As will become clear during the description of the operation of the present invention, cap 11 includes a first indicia in the form of an arrow 17. Arrow 17 indicates an appropriate location of the cap 11 on tube 13 prior to any use. Similarly, tube 13 includes a second indicia arrow 19 which is to be lined up with arrow 17 after the closure has been opened.

Turning first to the cap 11, ridges or grooves 21 cover a portion of the cap 11 to permit gripping and facilitate twisting of the cap 11. Cap 11 includes a terminal end 23 which has an annular ring defining a socket 25 on the inside of end 23 and facing tube 13. Socket 25 is axially aligned with a stem 27. Stem 27 is part of the nozzle of tube 13. Cap 11 is fixed in a first position where the stem 27 and socket 25 are spaced from one another. This first position is defined by groove 29 in cap 11 and ring 31 in tube neck 33 of tube 13. Groove 29 and ring 31 serve to locate the cap 11 on tube neck 33. As shown in FIG. 3, stem 27 is spaced from socket 25 prior to use of the cap and tube assembly.

Stem 27 is mounted on tube neck 33 by a thin wall 35 drawn by the molding operation. Thin wall 35 is easily frangible and can easily be ruptured by pressure on stem 27. One unique feature of the present invention is the inclusion of a plurality of bridges 37 which are attached to stem 27 at one end and to the tube neck 33 and thin wall membrane 35 as shown in FIGS. 3 and 4. Bridges 37 serve to strengthen the junction of stem 27 on tube neck 33 in the axial direction. Thus, when the device is activated as hereinafter described, stem 27 resists axial movement into the tube 13 so that stem 27 seats properly in socket 25.

To assist in the seating of stem 27 in socket 25, a groove 39 is formed in the interior of socket 25 to cooperate with a ring 41 on stem 27. This ring and groove, 41 and 39, comprise a stem locking means for positively locating the stem 27 in the socket 25 at a predetermined position. The interior of socket 25 and the exterior of stem 27 may also be tapered in order to provide a frictional fit as well.

Figure 5:
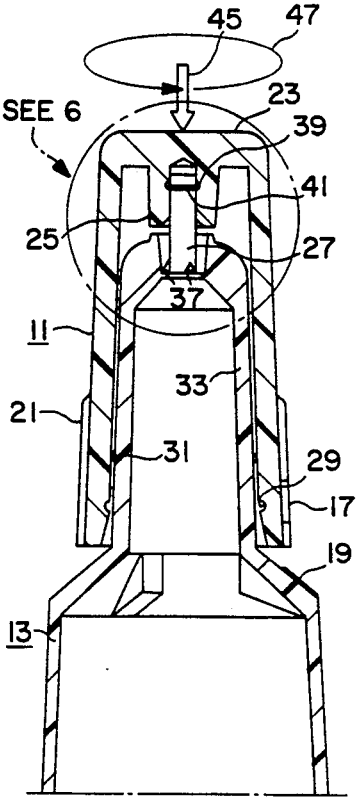
FIG. 5 is a view similar to FIG. 2, showing the closure member in a frictionally engaged position.

In FIG. 5, pressure is exerted on the end 23 of cap 11 in the direction shown by arrow 45. This causes ring 31 to escape groove 29 and stem 27 moves into socket 25. When stem 27 has moved to the position shown in FIG. 6, ring 41 and groove 39 function to lock the stem in the socket at a predetermined position. Bridges 37 resist axial movement of the stem 27 and permit engagement of the locking means as described.

This first movement of the stem 27 into socket 25 normally takes place when the assembly is in the position shown in FIG. 1, and indicia arrow 17 is not aligned with indicia arrow 19. After stem 27 is locked in place in socket 25, arrow 17 is turned by twisting the cap 11 so that indicia arrows 17 and 19 are aligned with each other. This 90 degree rotation in the direction shown by arrow 47 of FIG. 5 causes the thin wall membrane 35 to rupture. Bridges 37 are only slightly contacting tube neck 33 and offer no substantial resistance to radial movement in the direction shown by arrow 47. As a result, stem 27 is broken free from tube neck 33.

Figure 8:
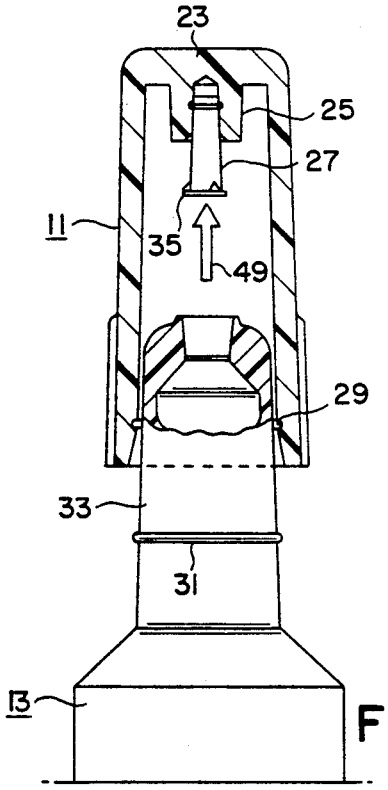
FIG. 8 is an enlarged fragmentary elevational view, with parts broken away and in section, showing the closure being separated from the collapsible tube nozzle.
Figure 9:
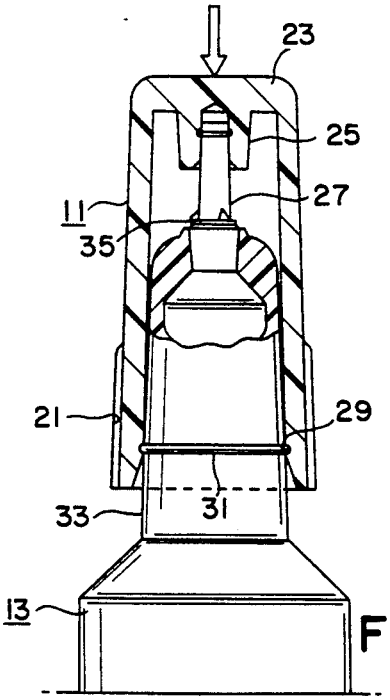
FIG. 9 is a view similar to FIG. 8, showing the closure member and the retained nozzle stem, replaced on the collapsible tube after use.

It is then easy to remove cap 11 from tube neck 33, shown by movement in the direction of arrow 49 in FIG. 8. Because the thin wall is recessed back from the terminal end of tube neck 33, fragments and torn portions of the membrane are not exposed and will not present a danger when the tube assembly is used to dispense the contents. After dispensing the contents, the cap 11 can be replaced on tube end 33 as shown in FIG. 9, for future use or disposal.

While particular embodiments of the present invention have been illustrated and described herein, it is not intended to limit the invention. Changes and modifications may be made therein within the scope of the following claims.

What is claimed is:

1. A container and closure assembly, comprising:

a) a container having a neck portion terminating in a discharge opening;

b) an elongated stem ember comprising a stem connected at its inner end by frangible means to normally seal said discharge opening;

c) a cup-shaped closure having an inwardly facing stem engaging socket member comprising a socket and axially moveable relative to the neck of the container between unarmed and armed limit positions;

d) first interengaging releasable locking means on the closure and neck normally positioning said closure in an unarmed position wherein said socket and stem are axially spaced so that the stem is prevented from being activated and releasable to permit relative axial movement to engage the stem in the socket in an armed position;

e) second interengaging locking means comprising a radially directed rib on one of said members engaging in a complementary groove in the other of said members to thereby lock the stem in the socket in the armed positioned whereby the closure is rotated to fracture the frangible means and permit discharge of the contents through the discharge opening.

2. A container-closure assembly as claimed in claim 1 wherein said closure is made of a transparent material so that the stem and frangible connection are visible to determine condition of seal.

3. A container-closure assembly as claimed in claim 1 wherein said discharge opening is an elongated channel in one end of the neck of the container and the frangible diaphragm is disposed at the inner end of said channel.

4. A container-closure assembly as claimed in claim 1 wherein said frangible connecting means comprises an annular thin wall portion between the stem and discharge opening and a plurality of radially extending circumferentially spaced bridges between the stem and a side wall defining the discharge opening.

5. A container-closure assembly as claimed in claim 1 wherein said socket opening is tapered and said stem is of a complementary taper of a dimension in relation to the socket opening to provide a press fit of the stem in the socket opening when the cap is actuated axially to the armed position whereby the cap can be rotated to break the frangible means connecting the stem over the discharge opening.

6. A container closure assembly as claimed in claim 1 wherein said second locking means comprises a radially outward directed, circumferentially extending rib on the stem which engages in a complementary groove in the socket opening to lock the stem in an axial direction in the socket opening in the armed position whereby upon axial movement of the cap away from the neck, the stem remains locked in the socket of the closure.

7. A container closure assembly as claimed in claim 1 including indicia on the side wall of the closure and the container which are circumferentially spaced apart a predetermined angular distance in the unarmed position of the closure.

8. A container-closure assembly as claimed in claim 1 wherein said first interengaging locking means comprises a radially outwardly directed circumferentially extending rib on the neck of the container spaced downwardly from the discharge opening and a complementary circumferentially extending groove in an internal wall of the skirt portion of the closure spaced upwardly from its lower terminal edge.

* * * * *